US010717577B2

(12) United States Patent
Ohmae et al.

(10) Patent No.: US 10,717,577 B2
(45) Date of Patent: Jul. 21, 2020

(54) PLASTIC BAG MAKING APPARATUS

(71) Applicant: Fuji Seal International, Inc., Osaka (JP)

(72) Inventors: Hideki Ohmae, Osaka (JP); Mikio Totani, Kyoto (JP); Hiroshi Nagata, Kyoto (JP); Masakazu Hashimoto, Kyoto (JP)

(73) Assignee: Fuji Seal International, Inc., Osaka (JP)

( * ) Notice: Subject to any disclaimer, the term of this patent is extended or adjusted under 35 U.S.C. 154(b) by 271 days.

(21) Appl. No.: 15/877,790

(22) Filed: Jan. 23, 2018

(65) Prior Publication Data

US 2018/0186535 A1 Jul. 5, 2018

Related U.S. Application Data

(62) Division of application No. 14/377,201, filed as application No. PCT/JP2012/079821 on Nov. 16, 2012, now Pat. No. 9,932,161.

(30) Foreign Application Priority Data

Feb. 8, 2012 (JP) ..... 2012-025057

(51) Int. Cl.
*B65D 75/00* (2006.01)
*B65D 75/58* (2006.01)
(Continued)

(52) U.S. Cl.
CPC ..... *B65D 75/008* (2013.01); *B31B 70/844* (2017.08); *B65D 75/5877* (2013.01);
(Continued)

(58) Field of Classification Search
CPC ..... B65D 75/008; B65D 75/5877; B31B 70/844; B31B 70/84; B31B 70/85;
(Continued)

(56) References Cited

U.S. PATENT DOCUMENTS 3,244,576 A * 4/1966 Swartz ..... B29C 66/8242 156/513
3,380,646 A 4/1968 Doyen et al.
(Continued)

FOREIGN PATENT DOCUMENTS

EP 0 626 921 A 12/1994
JP S56-118845 A 9/1981
(Continued)

OTHER PUBLICATIONS

International Search Report and Written Opinion dated Feb. 19, 2013 for Application No. PCT/JP2012/079821, 14 pgs.
(Continued)

*Primary Examiner* — Thomas M Wittenschlaeger
(74) *Attorney, Agent, or Firm* — Frost Brown Todd LLC

(57) ABSTRACT

An apparatus to successively make plastic bags, each of which includes an end surface provided with a spout, by employing the general feeding way of panel material, to be simple in structure, low in cost, high in speed, and to make it possible to successively make the plastic bags two by two. A folded portion is formed in a first web of panel material, an aperture is formed in a web of end surface material, a spout is inserted into the aperture, the spout and the web of end surface material being heat sealed with each other. The web of end surface material and the folded portion are heat sealed with each other while the web of end surface material and a second web of panel material are heat sealed with each other about the spout.

4 Claims, 6 Drawing Sheets

(51) Int. Cl.
*B31B 70/84* (2017.01)
*B31B 160/20* (2017.01)
*B31B 155/00* (2017.01)

(52) U.S. Cl.
CPC ..... *B31B 2155/00* (2017.08); *B31B 2155/002* (2017.08); *B31B 2155/0014* (2017.08); *B31B 2160/20* (2017.08)

(58) Field of Classification Search
CPC ... B31B 70/853; B31B 70/855; B31B 70/859; B31B 2155/00; B31B 2155/0014; B31B 2155/002; B31B 2160/20; B31B 50/857
See application file for complete search history.

(56) References Cited

U.S. PATENT DOCUMENTS 3,434,908 A * 3/1969 MacDonald ..... B29C 66/131 156/514
3,894,381 A * 7/1975 Christine ..... B29C 65/18 53/133.2
5,254,073 A * 10/1993 Richison ..... B65D 33/2533 493/195
5,868,658 A * 2/1999 Wild ..... B31B 50/00 493/196
6,561,963 B2 5/2003 Totani
6,648,808 B2 11/2003 Totani
6,783,277 B2 8/2004 Edwards et al.
6,796,932 B2 9/2004 Kuge et al.
7,044,184 B2 5/2006 Totani
7,410,452 B2 * 8/2008 Nishibe ..... B65D 75/5894 493/116
7,497,624 B2 3/2009 Totani
7,600,360 B2 * 10/2009 Schroeder ..... B65B 61/186 53/452
7,775,957 B2 8/2010 Totani
7,866,886 B2 * 1/2011 Kurosawa ..... B29C 65/18 383/200
7,950,850 B2 5/2011 Fukuizumi
8,414,465 B2 4/2013 Totani
8,579,779 B2 11/2013 Totani
8,715,148 B2 5/2014 Totani
8,745,836 B2 * 6/2014 Murray ..... B31B 70/00 29/428
8,777,826 B2 7/2014 Totani
8,790,229 B2 7/2014 Font Lletche
8,806,843 B2 8/2014 Chang
8,828,166 B2 * 9/2014 Grass ..... B29C 66/3452 156/73.1
8,997,616 B2 4/2015 Totani
8,997,817 B2 4/2015 Totani
9,114,569 B2 * 8/2015 Murray ..... B29C 65/5057
9,205,597 B2 12/2015 Totani et al.
9,604,426 B2 3/2017 Totani
9,636,883 B2 * 5/2017 Nagano ..... B31B 70/844
9,932,161 B2 4/2018 Ohmae et al.
10,189,608 B2 1/2019 Totani
2003/0073557 A1 4/2003 Totani
2011/0039676 A1 2/2011 Totani
2012/0275727 A1 * 11/2012 Chang ..... B65D 75/5877 53/133.2
2014/0187401 A1 7/2014 Totani
2015/0183176 A1 7/2015 Totani
2017/0173913 A1 6/2017 Totani
2017/0203532 A1 7/2017 Totani
2017/0259518 A1 9/2017 Totani
2017/0266905 A1 9/2017 Totani
2017/0266906 A1 9/2017 Totani
2018/0056619 A1 3/2018 Totani
2018/0118435 A1 5/2018 Ohmae et al.
2018/0127183 A1 5/2018 Ohmae et al.
2018/0222141 A1 8/2018 Totani
2019/0308384 A1 * 10/2019 Totani ..... B31B 70/844

FOREIGN PATENT DOCUMENTS

JP H09-300486 A 11/1997
JP 2000-313076 A 11/2000
JP 2003-211562 A 7/2003
JP 2004-136558 A 5/2004
JP 3655627 B2 6/2005
JP 2011-046082 A 3/2011
JP 2012-006330 A 1/2012
WO WO 93/16928 A1 9/1993
WO WO 2004/009341 A1 1/2004
WO WO 2011/015696 A1 2/2011

OTHER PUBLICATIONS

European Search Report, Supplementary Partial, dated Jan. 13, 2016 for Application No. EP 12868301.8, 9 pgs.
European Search Report, Supplementary Partial, and Written Opinion dated Apr. 29, 2016 for Application No. EP 12868301.8, 17 pgs.
European Examination Report dated Jan. 19, 2018 for Application No. EP 12868301.8, 4 pgs.
European Search Report and Written Opinion dated Sep. 17, 2018 for Application No. EP 18177632.9, 9 pgs.
European Search Report and Written Opinion dated Sep. 28, 2018 in Application No. EP 18177633.7, 9 pgs.
European Search Report, Partial, and Written Opinion dated Oct. 24, 2018 for Application No. EP 18166735.3, 11 pgs.
European Exam Report dated Jan. 19, 2018 for Application No. EP 12868301.8, 4 pgs.
Japanese Office Action, Notification of Reasons for Refusal, dated Mar. 23, 2016 for Application No. JP 2012-025057, 3 pgs.
Japanese Office Action, Decision to Grant a Patent, dated Sep. 14, 2016 for Application No. JP 2012-025057, 3 pgs.
European Search Report and Written Opinion dated Mar. 15, 2019 for Application No. EP 18207756.0, 8 pgs.
European Examination Report dated Aug. 28, 2019 for Application No. EP 18177632.9, 5 pgs.

* cited by examiner

A

B

A

B

C

PLASTIC BAG MAKING APPARATUS

PRIORITY

This application is a divisional of U.S. patent application Ser. No. 14/377,201, entitled "Plastic Bag Making Apparatus," filed Aug. 7, 2014 and issued as U.S. Pat. No. 9,932,161 on Apr. 3, 2018, which is a national stage entry of PCT/JP2012/079821, entitled "Plastic Bag Making Apparatus," filed Nov. 16, 2012, which claims priority to Japanese Patent Application JP 2012025057, filed on Feb. 8, 2012, the disclosures of which are incorporated by reference herein.

TECHNICAL FIELD

The invention relates to an apparatus for successively making plastic bags each of which includes an end surface provided with a spout.

BACKGROUND

There has been known and used a plastic bag including an end surface provided with a spout. Japanese Laid-Open Patent Publication No. 46082 of 2011 discloses an apparatus for successively making the plastic bags.

In the apparatus of the patent publication, first and second webs of panel material are superposed with each other and disposed along a vertical plane. The direction of length is horizontal in the first and second webs of panel material, but the direction of width is vertical. The first web of panel material is folded along a first longitudinal folded line extending adjacent to one side edge so that a first folded portion should be formed in the first web of panel material. The second web of panel material is folded along a corresponding longitudinal folded line at a position corresponding to the first longitudinal folded line. In addition, the second web of panel material is folded along a second longitudinal folded line extending between one side edge and the corresponding longitudinal folded line so that a second folded portion should be formed in the second web of panel material to be disposed along the vertical plane. Moreover, the first and second webs of panel material are fed longitudinally thereof and intermittently. A spout is inserted into an aperture formed in the second folded portion, the spout and the second folded portion being heat sealed with each other by a spout seal device, when the first and second webs of panel material are stopped temporarily. The second folded portion is then superposed with the first folded portion so that the spout should be positioned on the first longitudinal folded line and the corresponding longitudinal folded line. The second folded portion and the first folded portion are heat sealed with each other while the second folded portion and the second web of panel material are heat sealed with each other about the spout by a circumferential seal device when the first and second webs of panel material are stopped temporarily.

In the apparatus of the patent publication, a web of end surface material is formed between the other side edges of the first and second webs of panel material.

The apparatus can therefore successively make the plastic bags each of which includes the end surface formed by the second folded portion to be provided with the spout. In addition, the plastic bag includes opposite end surfaces one of which is provided with the spout. The other end surface is formed by the web of end surface material to make the plastic bag stand stably. The plastic bag is called a standing pouch.

However, the apparatus is problematic in that the first and second webs of panel material are disposed along the vertical plane and fed longitudinally thereof and intermittently. The direction of width is vertical in the first and second webs of panel material so that the first and second webs of panel material must be subject to gravity widthwise thereof. The first and second webs of panel material have therefore to be held conveniently and fed longitudinally thereof and intermittently not to misalign widthwise thereof by gravity, making the apparatus complicated in structure. In addition, the spout is inserted into the aperture with the second folded portion being disposed along the vertical plane. The spout and the second folded portion are then heat sealed with each other. The spout has therefore to be inserted sideways and then kept from dropping. The spout and the second folded portion have to be heat sealed sideways. As a result, the apparatus must to be complicated in structure to be high in cost. It is difficult to successively make the plastic bags at high speed because of structure of the apparatus.

In addition, the apparatus is arranged to successively make the plastic bags one by one. It is difficult to successively make the plastic bags two by two.

On the other hand, being not associated with the spout, Japanese Patent No. 3,655,627 discloses an apparatus for successively making plastic bags, in which first and second webs of panel material are disposed not along a vertical plane but along a horizontal plane and fed longitudinally thereof and intermittently. This feeding way of panel material is general, which has no problem of misaligning of the first and second webs of panel material by gravity. Japanese Patent Publication No. 4,402,872 also discloses an apparatus for successively making plastic bags, in which first and second webs of panel material are disposed along a horizontal plane and fed longitudinally thereof and intermittently. In the apparatus, a spout is positioned with and inserted into an aperture by difference in speed, but the plastic bag includes no end surface provided with the spout.

It is therefore an object of the invention to provide an apparatus for successively making plastic bags each of which includes an end surface provided with a spout, by employing the general feeding way of panel material, to be simple in structure, low in cost and high in speed and to make it possible to successively make the plastic bags two by two.

SUMMARY OF THE INVENTION

The application contains four inventions. According to the first invention, a first web of panel material is previously folded along a first longitudinal folded line extending adjacent to one side edge so that a first folded portion should be formed in the first web of panel material. A second web of panel material is then superposed with the first web of panel material on opposite side to the first folded portion to have one side edge protruding beyond the first longitudinal folded line at a distance. In addition, the first and second webs of panel material are disposed along a horizontal plane and fed longitudinally thereof and intermittently. An aperture is formed in the second web of panel material at a position between the one side edge of the second web of panel material and the first longitudinal folded line by an aperture forming device when the first and second webs of panel material are stopped temporarily. A spout is inserted into the aperture, the spout and the second web of panel material being heat sealed with each other by a spout seal device, when the first and second webs of panel material are stopped temporarily. The second web of panel material is guided by a guide device to be folded along a second longitudinal folded line extending between the spout and the first longitudinal folded line when the first and second webs of panel material are fed after the spout and the second web of panel material are heat sealed so that a second folded portion should be formed in the second web of panel material. The spout is turned over by the second folded portion. The second folded portion is superposed with the first folded portion. The second folded portion and the first folded portion are heat sealed with each other while the second folded portion and the second web of panel material are heat sealed with each other about the spout by a circumferential seal device when the first and second webs of panel material are stopped temporarily. The end surface is therefore formed by the second folded portion to be provided with the spout.

In a preferred embodiment of the invention, the spout is positioned on the first longitudinal folded line when the second folded portion is superposed with the first folded portion.

A web of end surface material is supplied from an end surface material supply mechanism to extend longitudinally of the first and second webs of panel material. The web of end surface material is inserted between the first and second webs of panel material. The first and second webs of panel material and the web of end surface material are heat sealed with each other longitudinally of the first and second webs of panel material by a longitudinal seal device when the first and second webs of panel material are stopped temporarily. The first and second webs of panel material are heat sealed with each other widthwise thereof by a cross seal device when being stopped temporarily. The first and second webs of panel material are cut widthwise thereof by a cross cutter when being stopped temporarily. The plastic bag includes opposite end surfaces one of which is provided with the spout. The other end surface is formed by the web of end surface material.

The plastic bag may be cut out of the first and second webs of panel material by a cut out device when the first and second webs of panel material are stopped temporarily.

The first web of panel material may be previously folded along first longitudinal folded lines extending adjacent to opposite side edges so that first folded portions should be formed in the first web of panel material. In this case, the second web of panel material is then superposed with the first web of panel material on opposite side to the first folded portions to have opposite side edges protruding beyond the first longitudinal folded line at a distance. Apertures are formed in the second web of panel material at positions between the opposite side edges of the second web of panel material and the first longitudinal folded lines by an aperture forming device when the first and second webs of panel material are stopped temporarily. Spouts are inserted into the apertures.

According to the second invention, first and second webs of panel material are superposed with each other. The first web of panel material has one side edge protruding beyond one side edge of the second web of panel material at a distance. In addition, the first and second webs of panel material are disposed along a horizontal plane and fed longitudinally thereof and intermittently. An aperture is formed in the first web of panel material at a position between the one side edges of the first and second webs of panel material by an aperture forming device when the first and second webs of panel material are stopped temporarily. A spout is inserted into the aperture, the spout and the first web of panel material being heat sealed with each other by a spout seal device, when the first and second webs of panel material are stopped temporarily. The first web of panel material is guided by a guide device to be folded and folded back along a longitudinal folded line and a longitudinal folded back line extending at positions predetermined widthwise of the first web of panel material when the first and second webs of panel material are fed after the spout and the first web of panel material are heat sealed so that a folded portion and a folded back portion should be formed in the first web of panel material. The spout and the longitudinal folded line are positioned between the one side edge of the first web of panel material and the longitudinal folded back line and positioned between the one side edge of the second web of panel material and the longitudinal folded back line. The folded portion and the folded back portion are heat sealed with each other while the folded back portion and the second web of panel material are heat sealed with each other about the spout by a circumferential seal device when the first and second webs of panel material are stopped temporarily. The end surface is therefore formed by the folded back portion to be provided with the spout.

According to the third invention, a wide web of panel material is fed longitudinally thereof and intermittently. An aperture is formed in the wide web of panel material at a position predetermined widthwise of the wide web of panel material by an aperture forming device when the wide web of panel material is stopped temporarily. A spout is inserted into the aperture, the spout and the wide web of panel material being heat sealed with each other by a spout seal device, when the wide web of panel material is stopped temporarily. The wide web of panel material is guided by a guide device to be folded and folded back along a first longitudinal folded line and a longitudinal folded back line extending between one side edge and the spout when the wide web of panel material is fed after the spout and the wide web of panel material are heat sealed so that a first folded portion and a folded back portion should be formed in the wide web of panel material. The wide web of panel material is folded along a second folded line extending at a position predetermined widthwise of the wide web of panel material so that a second folded portion should be formed in the wide web of panel material. The spout is turned over by the second folded portion. The spout and the folded back line are positioned between the first and second longitudinal folded lines. The second folded portion and the first folded portion are heat sealed with each other while the second folded portion and the wide web of panel material are heat sealed with each other about the spout by a circumferential seal device when the wide web of panel material is stopped temporarily. The end surface is therefore formed by the second folded portion to be provided with the spout.

According to the forth invention, a first web of panel material is previously folded along a longitudinal folded line extending adjacent to one side edge so that a folded portion should be formed in the first web of panel material. A second web of panel material is then superposed with the first web of panel material on opposite side to the folded portion to have one side edge protruding beyond the longitudinal folded line at a distance. In addition, the first and second webs of panel material are disposed along a horizontal plane and fed longitudinally thereof and intermittently, with which a web of end surface material is combined. The web of end surface material includes apertures formed therein and spaced from each other longitudinally of the web of end surface material. The web of end surface material further includes spouts inserted into the apertures. The spouts and the web of end surface material are heat sealed with each other. The web of end surface material is then supplied to the first and second webs of panel material to extend along the longitudinal folded line so that the web of end surface material should be superposed with the folded portion and the second web of panel material. The web of end surface material and the folded portion are heat sealed with each other while the web of end surface material and the second web of panel material are heat sealed with each other about the spout by a circumferential seal device when the first and second webs of panel material are stopped temporarily. The end surface is therefore formed by the web of end surface material to be provided with the spout.

DETAILED DESCRIPTION

Figure 1:
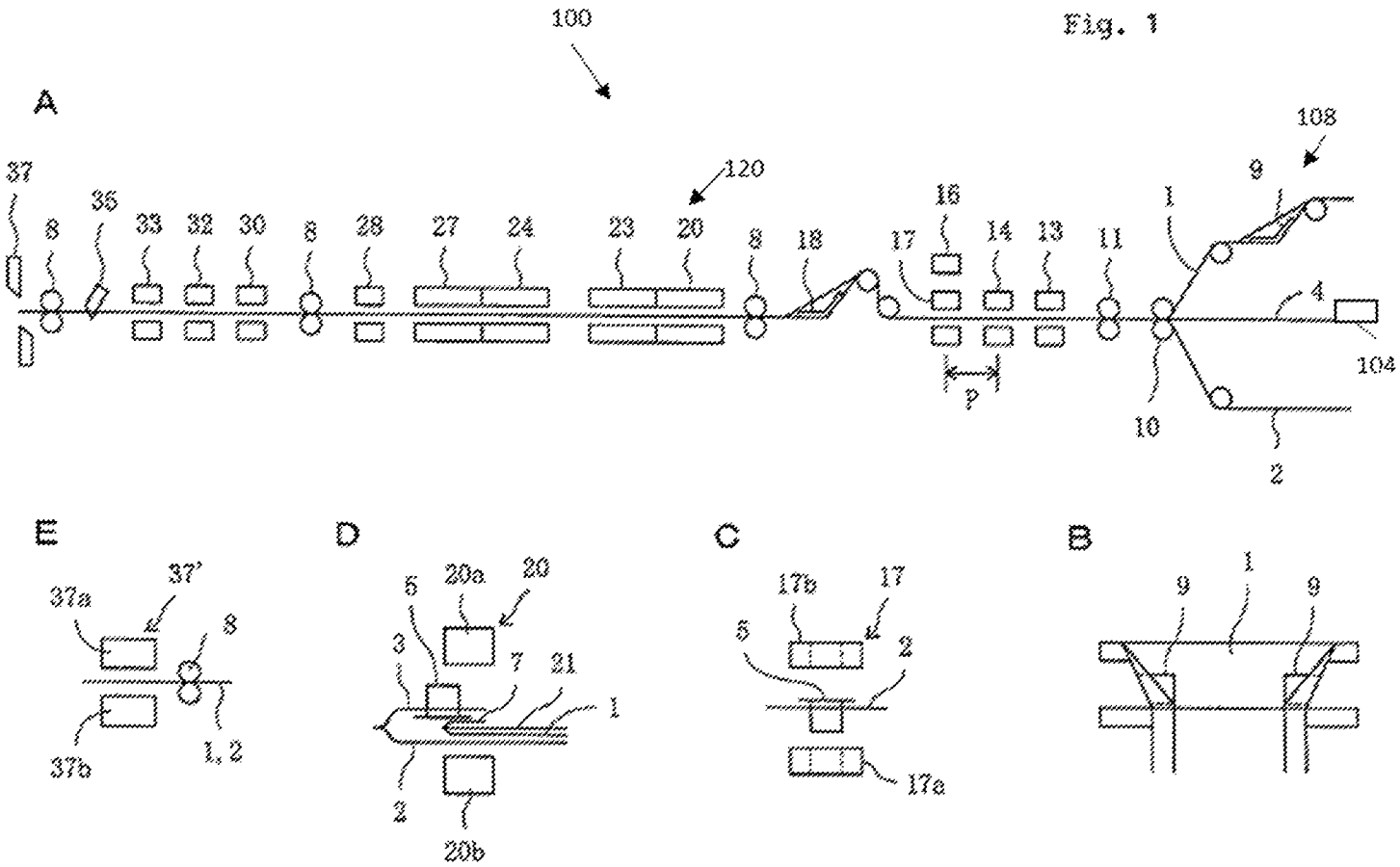
FIG. 1 is a side view (A) of a preferred embodiment of the invention, an elevational view (B) of the guide device of (A), an enlarged view (C) of the spout seal device of (A), an elevational and sectional view (D) of the circumferential seal device of (A) and a side view (E) of another embodiment.
Figure 3:
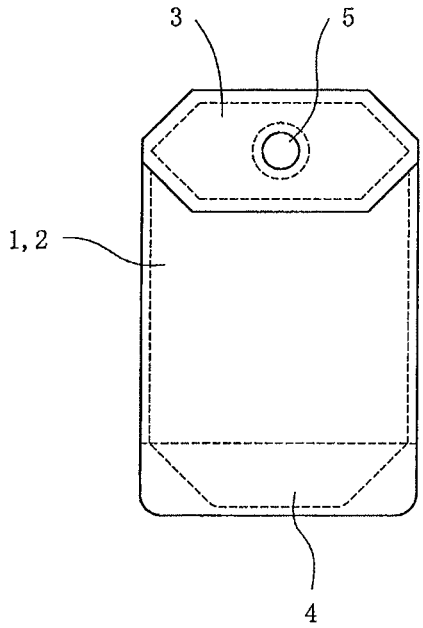
FIG. 3 is a plan view (A) of the plastic bag obtained by the apparatus of FIG. 1 and a perspective view (B) of the plastic bag of (A) after being filled with content.
Figure 3:
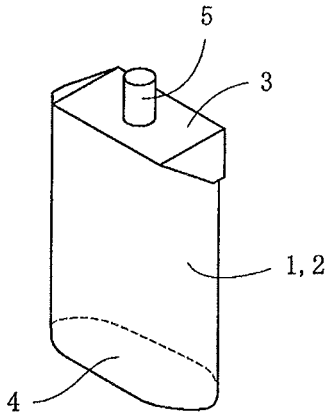

Turning now to the drawings, FIG. 1 illustrates an apparatus 100 for successively making plastic bags of FIG. 3, according to the invention. The plastic bag includes panel portions 1 and 2, opposite end surfaces 3 and 4 and a spout 5 to be filled with content. In the plastic bag, one of the end surfaces 3 is provided with the spout 5 through which the content is discharged. The other end surface 4 makes the plastic bag stand stably. The plastic bag is called a standing pouch.

Figure 2:
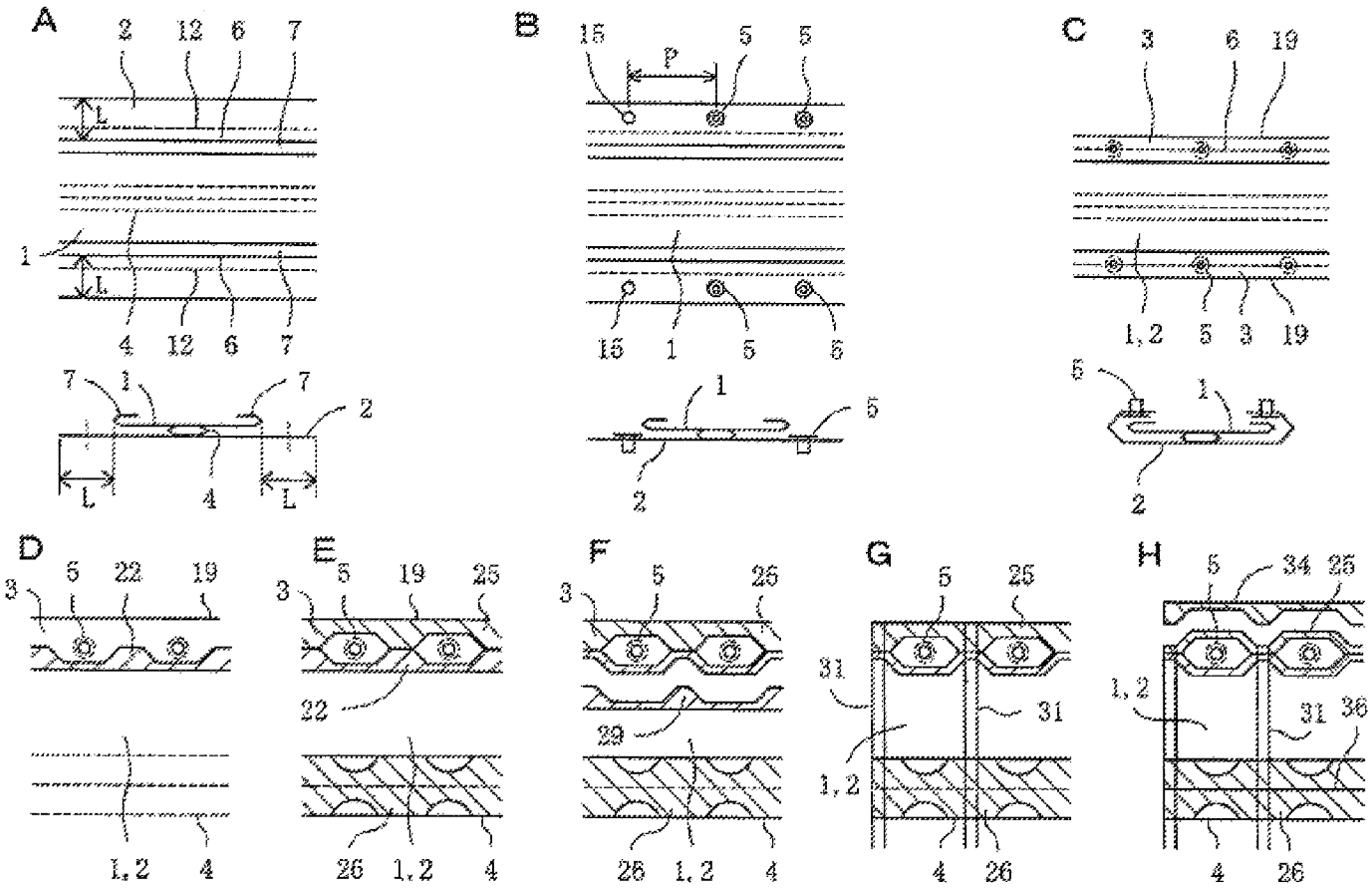
FIG. 2 is a plan view and an elevational and sectional view (A) of the first and second webs of panel material and the web of end surface material of FIG. 1, a plan view and an elevational and sectional view (B) of the step next to (A), a plan view and an elevational and sectional view (C) of the step next to (B), a plan view (D) of the step next to (C), a plan view (E) of the step next to (D), a plan view (F) of the step next to (E), a plan view (G) of the step next to (F) and a plan view (H) of the step next to (G).

In order to successively make the plastic bags of FIG. 3, in the apparatus of FIG. 1, a first web of panel material 1 is previously folded along a first longitudinal folded line 6 extending adjacent to one side edge so that a first folded portion 7 should be formed in the first web of panel material 1, as shown in FIG. 2. The first web of panel material 1 comprises a plastic film. In the embodiment, the apparatus includes a feeding device 108 comprising feeding rollers 8 to which the first web of panel material 1 is directed through a guide device 9. The feeding rollers 8 are rotated intermittently by a motor so that the first web of panel material 1 should be fed longitudinally thereof and intermittently. In addition, the first web of panel material 1 is guided by the guide device 9 to be folded along the first longitudinal folded line 6 extending adjacent to the one side edge when being fed. For example, the guide device 9 comprises guide rollers and a plate by which the first web of panel material 1 is guided to be pulled down and folded upwardly, as in the case of the apparatus of Japanese Patent No. 3,655,627, so that the first folded portion 7 should be formed in the first web of panel material 1 (FIG. 1 B).

In the apparatus of FIG. 1, a second web of panel material 2 is then superposed with the first web of panel material 1 on opposite side to the first folded portion 7 to have one side edge protruding beyond the first longitudinal folded line 6 at a distance L. In the embodiment, the first web of panel material 1 is supplied from above to be directed to guide rollers 10 while the second web of panel material 2 is supplied from below to be directed to the guide rollers 10. It should therefore be understood that the second web of panel material 2 is superposed with the first web of panel material 1 on opposite side to the first folded portion 7. The first and second webs of panel material 1 and 2 are then directed to the feeding rollers 8 to be disposed along a horizontal plane and fed longitudinally thereof and intermittently. The first and second webs of panel material 1 and 2 are fed intermittently at a pitch P corresponding to the width of the plastic bag. In the embodiment, the first and second webs of panel material 1 and 2 pass through the guide rollers 10 to be directed to perforating blades 11. The perforating blades 11 are engaged with the second web of panel material 2 so that a perforation 12 should be formed in the second web of panel material 2 at a position between the one side edge of the second web of panel material 2 and the first longitudinal folded line 6 when the second web of panel material 2 is fed. The perforating blades 11 comprise rotary blades which are rotated at a speed corresponding to the second web of panel material 2 fed longitudinally thereof and intermittently to make the perforations 12 formed (FIG. 2 A).

The apparatus further includes an end surface material supply mechanism 104 from which a web of end surface material 4 is supplied to extend longitudinally of the first and second webs of panel material 1 and 2. The web of end surface material 4 is folded into halves and inserted between the first and second webs of panel material 1 and 2. The first and second webs of panel material 1 and 2 and the web of end surface material 4 are directed to a temporarily fixing device 13 so that the first web of panel material 1 and the web of end surface material 4 should be heat sealed or ultrasonic sealed with each other to be temporarily fixed to each other, the second web of panel material 2 and the web of end surface material 4 being heat sealed or ultrasonic sealed with each other to be temporarily fixed to each other, by the temporarily fixing device 13 when the first and second webs of panel material 1 and 2 are stopped temporarily whenever being fed intermittently. The second web of panel material 2 is then directed to an aperture forming device 14 so that an aperture 15 should be formed in the second web of panel material 2 at a position between the one side edge of the second web of panel material 2 and the first longitudinal folded line 6 when the first and second webs of panel material 1 and 2 are stopped temporarily whenever being fed intermittently (FIG. 2 B). The aperture forming device 14 comprises a punch unit.

The apparatus is arranged to successively making the plastic bags two by two. The first web of panel material 1 is therefore folded along first folded lines 6 extending adjacent to opposite side edges so that first folded portions 7 should be formed in the first web of panel material 1. The second web of panel material 2 is then superposed with the first web of panel material 1 on opposite side to the first folded portions 7 to have opposite side edges protruding beyond the first longitudinal folded lines 6 at the distance L. In addition, apertures 15 are formed in the second web of panel material 2 at positions between the opposite side edges of the second web of panel material 2 and the first folded lines 6 by the aperture forming device 14 when the first and second webs of panel material 1 and 2 are stopped temporarily whenever being fed intermittently.

In the apparatus of FIG. 1, for example, the end surface material supply mechanism comprises a roll from which the web of end surface material 4 is supplied. The web of end surface material 4 has a double width, which is folded into halves on opposite sides of the longitudinal center line to be superposed into two layers. The web of end surface material 4 is inserted between the first and second webs of panel material 1 and 2 at the position of the longitudinal center-lines thereof. The first and second webs of panel material 1 and 2 and the web of end surface material 4 are then directed to the temporarily fixing device 13 so that the first and second webs of panel material 1 and 2 and the web of end surface material 4 are temporarily fixed to each other along the longitudinal center lines thereof. Each of the first and second webs of panel material 1 and 2 and the web of end surface material 4 comprises a laminated film including a sealant such as polyethylene, polypropylene. The sealant is laminated on a base material such as biaxially-drawn polyester film (PET), biaxially-drawn nylon film (Ny) directly or via a barrier layer such as aluminum foil (Al), ethylene vinyl alcohol copolymer (EVOH). The temporarily fixing device 13 may therefore include a heat seal bar, the first and second webs of panel material 1 and 2 and the web of end surface material 4 being sandwiched between the heat seal bar and a receiver. In this case, the first web of panel material 1 and the web of end surface material 4 are heat sealed with each other to be temporarily fixed to each other while the second web of panel material 2 and the web of end surface material 4 are heat sealed with each other to be temporarily fixed to each other by the sealant. The temporarily fixing device 13 may comprise an ultrasonic seal device by which the first web of panel material 1 and the web of end surface material 4 are ultrasonic sealed with each other to be temporarily fixed to each other while the second web of panel material 2 and the web of end surface material 4 are ultrasonic sealed with each other to be temporarily fixed to each other.

The second web of panel material 2 is then directed to a spout inserting device 16 and a spout seal device 17, a spout 5 being inserted into the aperture 15 by the spout inserting device 16. The spout includes an cylindrical portion for pouring the content and a flange portion formed of a resin such as polyethylene or polypropylene which is heat sealable with the sealant, the cylindrical portion being inserted into the aperture 15. The spout 5 and the second web of panel material 2 are heat sealed with each other by the spout seal device 17 when the first and second webs of panel material 1 and 2 are stopped temporarily whenever being fed intermittently. For example, the spout inserting device 16 comprises a robot by which the cylindrical portion of the spout 5 is inserted into the aperture 15 when the first and second webs of panel material 1 and 2 are stopped temporarily whenever being fed intermittently. The spout seal device 17 comprises a seal member 17*a* and a receiver 17*b* which are ring shaped so that the flange portion of the spout 5 and the second web of panel material 2 can be sandwiched between the seal member 17*a* and the receiver 17*b* (FIG. 1C) to be heat sealed with each other by the sealant.

The second web of panel material 2 is then directed to a guide device 18 by which the second web of panel material 2 is guided to be folded along a second longitudinal folded line 19 extending between the spout 5 and the first longitudinal folded line 6 when the first and second webs of panel material 1 and 2 are fed after the spout 5 and the second web of panel material 2 are heat sealed so that a second folded portion 3 should be formed in the second web of panel material 2. The spout 5 is turned over by the second folded portion 3. The second folded portion 3 is superposed with the first folded portion 7. For example, the guide device 18 includes guide rollers and a plate by which the second web of panel material 2 is guided to be pulled down and folded upwardly, as in the case of the apparatus of Japanese Patent No. 3,655,627. This makes the second folded portion 3 formed, the spout 5 being turned over by the second folded portion 3, the second folded portion 3 being superposed with the first folded portion 7.

The second web of panel material 2 is folded along the perforation 12 which is formed in the second web of panel material 2. It should therefore be understood that the second web of panel material 2 is folded exactly. The second folded portion 3 is superposed with the first folded portion 7 so that they should have the one side edges coincided with each other, the spout 5 being positioned on the first longitudinal folded line 6 (FIG. 2 C).

The first and second webs of panel material 1 and 2 are then directed to a circumferential seal device 120 by which the second folded portion 3 and the first folded portion 7 are heat sealed with each other while the second folded portion 3 and the second web of panel material 2 are heat sealed with each other about the spout 5 when the first and second webs of panel material 1 and 2 are stopped temporarily whenever being fed intermittently. In addition, the first and second webs of panel material 1 and 2 and the web of end surface material 4 are directed to a longitudinal seal device by which the first web of panel material 1 and the web of end surface material 4 are heat sealed with each other while the second web of panel material 1 and 2 and the web of end surface material 4 are heat sealed with each other longitudinally of the first and second webs of panel material 1 and 2 when the first and second webs of panel material 1 and 2 are temporarily stopped whenever being fed intermittently.

In the embodiment, the circumferential seal device 120 includes a heat seal device 20 to which the first and second webs of panel material 1 and 2 are directed. The heat seal device 20 includes a heat seal bar 20*a*, a plate 21 and a receiver 20*b* (FIG. 1 D), the plate 21 being inserted between the first folded portion 7 and the first web of panel material 1. The second folded portion 3 and the first folded portion 7 are sandwiched between the heat seal bar 20*a* and the plate 21 while the first and second web of panel material 1 and 2 are sandwiched between the plate 21 and the receiver 20*b* on one side of a straight line extending through the spouts 5 when the first and second webs of panel material 1 and 2 are stopped temporarily whenever being fed intermittently. The second folded portion 3 and the first folded portion 7 are therefore heat sealed with each other by the sealant to make a heat sealed portion 22 formed on one side of the straight line extending through the spouts 5. The heat sealed portion 22 is trapezoidal wave-shaped and spaced from the spout 5. The heat sealed portion 22 is then directed to a cooling device 23 by which the heat sealed portion 22 is nipped and cooled when the first and second webs of panel material 1 and 2 are stopped temporarily whenever being fed intermittently (FIG. 2 D).

The circumferential seal device and the longitudinal seal device further include a heat seal device 24 to which the first and second webs of panel material 1 and 2 and the web of end surface material 4 are directed. The heat seal device 24 includes a heat seal bar and a receiver. The second folded portion 3 and the second web of panel material 2 are sandwiched between the heat seal bar and the receiver on the other side of the straight line extending through the spouts 5, the first and second webs of panel material 1 and 2 and the web of end surface material 4 being also sandwiched between the heat seal bar and the receiver, when the first and second webs of panel material 1 and 2 are stopped temporarily whenever being fed intermittently. The second folded portion 3 and the second web of panel material 2 are therefore heat sealed with each other by the sealant to make a heat sealed portion 25 formed on the other side of the straight line extending through the spouts 5. The heat sealed portion 25 is also trapezoidal wave-shaped and spaced from the spout 5. The heat sealed portions 22 and 25 are therefore formed about the spout 5 so that the spout 5 should be surrounded by the heat sealed portions 22 and 25. In addition, the first and second webs of panel material 1 and 2 and the web of end surface material 4 are heat sealed with each other by the sealant to make a heat sealed portion 26 formed. The heat sealed portion 26 has a shape specific to the standing pouch and known in itself. The heat sealed portions 25 and 26 are then directed to a cooling device 27 by which the heat sealed portions 25 and 26 are nipped and cooled when the first and second webs of panel material 1 and 2 are stopped temporarily whenever being fed intermittently (FIG. 2 E).

The first and second webs of panel material 1 and 2 are then directed to a cut out device 28 including a Thomson blade and a receiver. In addition, a plate is inserted between the first folded portion 7 and the first web of panel material 1, as in the case of the heat seal device 20. The second folded portion 3 and the first folded portion 7 are sandwiched between the Thomson blade and the plate while the first and second webs of panel material 1 and 2 are sandwiched between the plate and the receiver on one side of the straight line extending through the spouts 5 when the first and second webs of panel material 1 and 2 are stopped temporarily whenever being fed intermittently. The second folded portion 3 and the first folded portion 7 are therefore cut out by the Thomson blade to make a waste 29 separated and make the heat sealed portion 22 reduced on one side of the straight line extending through the spouts 5. The waste 29 is also trapezoidal wave-shaped. As a result, the heat sealed portion 22 has a width which is approximately uniform (FIG. 2 F).

The first and second webs of panel material 1 and 2 are then directed to a cross seal device 30 including a heat seal bar and a receiver. The first and second webs of panel material 1 and 2 are sandwiched between the heat seal bar and the receiver so that the first and second webs of panel material 1 and 2 should be heat sealed widthwise thereof to make a heat sealed portion 31 formed, when the first and second webs of panel material 1 and 2 are stopped temporarily whenever being fed intermittently. The heat sealed portion 31 is then directed to a cooling device 32 to be nipped and cooled by the cooling device 32 when the first and second webs of panel material 1 and 2 are stopped temporarily whenever being fed intermittently (FIG. 2 G).

The first and second webs of panel material 1 and 2 are then directed to a cut out device 33 including a Thomson blade and a receiver. The second folded portion 3 and the second web of panel material 2 are sandwiched between the Thomson blade and the receiver on the other side of the straight line extending through the spout 5 when the first and second webs of panel material 1 and 2 are stopped temporarily whenever being fed intermittently. The second folded portion 3 and the second web of panel material 2 are therefore cut out by the Thomson blade to make a waste 34 separated and make the heat sealed portion 25 reduced. The waste 34 is also trapezoidal wave-shaped. As a result, the heat sealed portion 25 has a width which is approximately uniform (FIG. 2 H).

The first and second webs of panel material 1 and 2 and the web of end surface material 4 are then directed to a slitting blade 35 by which the first and second webs of panel material 1 and 2 are slit, the web of end surface material 4 being also slit, to make a slit line 36 formed when the first and second webs of panel material 1 and 2 are fed. The first and second webs of panel material 1 and 2 and the web of end surface material 4 are slit along the longitudinal center lines thereof.

The first and second webs of panel material 1 and 2 and the web of end surface material 4 are then directed to a cross cutter 37 by which the first and second webs of panel material 1 and 2 are cut widthwise thereof, the web of end surface material 4 being also cut widthwise thereof, when the first and second webs of panel material 1 and 2 are stopped temporarily whenever being fed intermittently. The first and second webs of panel material 1 and 2 and the web of end surface material 4 are cut along the longitudinal center line of the heat sealed portion 31.

In the apparatus, the first and second webs of panel material 1 and 2 are fed intermittently at the pitch P corresponding to the width of the plastic bag, as described previously. The aperture forming device 14 and the spout seal device 17 are spaced from each other at a distance corresponding to the pitch P. The spout inserting device 16 is disposed near the spout seal device 17. It should therefore understood that the apparatus can make the aperture 15 formed in the second web of panel material 2, make the spout 5 inserted in the aperture 15 and make the spout 5 and the second web of panel material 2 heat sealed with each other by the aperture forming device 14, the spout inserting device 16 and the spout seal device 17 when the first and second webs of panel material 1 and 2 are stopped temporarily whenever being fed intermittently. In addition, the first and second webs of panel material 1 and 2 have a length corresponding to the integral multiple of the pitch P between the spout seal device 17 and the heat seal device 20. The heat seal device 20, the cooling device 23, the heat seal device 24 and the cooling device 27 are spaced from each other at a distance corresponding to the pitch P or the integral multiple thereof. The apparatus can therefore make the second folded portion 3 and the first folded portion 7 heat sealed and cooled, make the second folded portion 3 and the second web of panel material 2 heat sealed and cooled and make the first and second webs of panel material 1 and 2 and the web of end surface material 4 heat sealed and cooled by the heat seal device 20, the cooling device 23, the heat seal device 24 and the cooling device 27 when the webs of panel material 1 and 2 are stopped temporarily whenever being fed. The cooling device 27, the cut out device 28 and the cut out device 33 are spaced from each other at a distance corresponding to the pitch P or the integral multiple thereof. The apparatus can therefore make the second folded portion 3 and the first folded portion 7 cut out to make the waste 29 separated, and make the second folded portion 3 and the second web of panel material 2 cut out to make the waste 34 separated by the cut out device 28 and 33 when the first and second webs of panel material 1 and 2 are stopped temporarily whenever being fed intermittently. The cross seal device 30, the cooling device 32 and the cross cutter 37 are spaced from each other at a distance corresponding to the pitch P or the integral multiple thereof. The apparatus can therefore make the first and second webs of panel material 1 and 2 heat sealed, cooled and cut by the cross seal device 30, the cooling device 32 and the cross cutter 37 when the first and second webs of panel material 1 and 2 are stopped temporarily whenever being fed intermittently.

The apparatus can therefore successively make the plastic bags two by two in which the webs of panel material 1 and 2 and the web of end surface material 4 are divided along the slit line 36. The plastic bag includes the panel portions 1 and 2 formed by the first and second webs of panel material 1 and 2 and the end surface formed by the second folded portion 3 to be provided with the spout 5. The plastic bag includes the opposite end surfaces one of which is formed by the second folded portion 3. The other end surface 4 is formed by the web of end surface material 4 to make the plastic bag stand stably.

In the apparatus, unlike the apparatus of Japanese Laid-Open Patent Publication No. 46,082 of 2011, the first and second webs of panel material 1 and 2 are disposed along the horizontal plane and fed longitudinally thereof and intermittently, having no problem of being subject to gravity to misalign widthwise thereof. The first and second webs of panel material 1 and 2 can therefore be fed intermittently without difficulty. The spout 5 has only to be inserted downwardly into the aperture 15 after the aperture 15 is formed, to be simple in structure for performance. The spout 5 may be positioned with and inserted into the aperture 15 by difference in speed, as in the case of the apparatus of Japanese Patent Publication No. 4,402,872. The spout 5 has not be kept from dropping after being inserted when the flange portion is formed in the spout 5 and engaged with the second web of panel material 2. The seal member 17*a* and the receiver 17*b* have only to be moved downwardly and upwardly when the spout 5 and the second web of panel material 2 are heat sealed with each other by the spout seal device 17, to be simple in structure. The second web of panel material 2 and the spout 5 have only to be folded and turned over by the guide device 18 after being heat sealed. The apparatus can therefore be simple in structure to be low in cost. It should be understood that the apparatus can successively make the plastic bags at high speed.

It should also be understood that the apparatus can successively make the plastic bags two by two without difficulty.

Contrary to the embodiment of FIG. 1 in which the first web of panel material 1 is supplied from above while the second web of panel material 2 is supplied from below, the first web of panel material 1 may be supplied from below, the second web of panel material 2 being supplied from above, so that they should be superposed with each other. In this case, the spout 5 has only be inserted upwardly into the aperture 15 formed in the second web of panel material 2 and then kept vertically, to be simple in structure. The spout 5 can be positioned with and inserted into the aperture 15 by difference in speed, as in the case of the apparatus of Japanese Patent Publication No. 4,402,872.

It is not always necessary to make the second folded portion 3 and the second web of panel material 2 cut out by the cut out device 33 and make the first and second webs 1 and 2 and the web of end surface material 4 cut by the cross cutter 37 as in the case of the embodiment of FIG. 1. A cut out device may be disposed at the position of the cross cutter 37 so that the plastic bag should be cut out of the first and second webs of panel material 1 and 2 when the first and second webs of panel material 1 and 2 are stopped temporarily whenever being fed intermittently. For example, a cut out device 37' is used, which comprises a Thomson blade 37*a* having a shape corresponding to the plastic bag (FIG. 1 E). The first and second webs of panel material 1 and 2 are sandwiched between the Thomson blade 37*a* and a receiver 37*b* so that the plastic bag should be cut out by the Thomson blade 37*a* when the first and second webs of panel material 1 and 2 are stopped temporarily whenever being fed intermittently.

Figure 4:
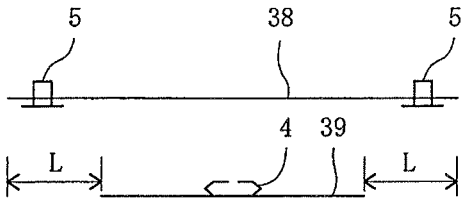
FIG. 4 is an elevational and sectional view (A) of another embodiment, an elevational and sectional view (B) of the step next to (A) and an elevational and sectional view (C) of the step next to (B).
Figure 4:
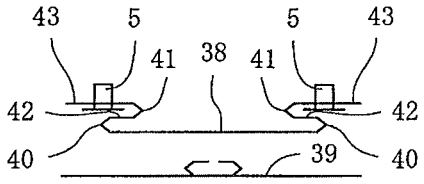
Figure 4:
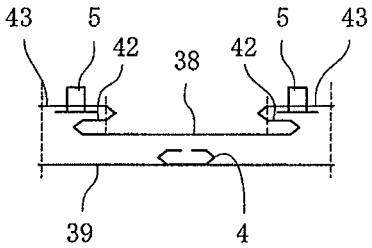

FIG. 4 illustrates another embodiment in which first and second webs of panel material 38 and 39 are supplied from above and below to be superposed with each other as in the case of the first and second webs of panel material 1 and 2 of FIG. 1. However, in the embodiment of FIG. 4, the first web of panel material 38 includes one side edge projecting beyond one side edge of the second web of panel material 39 at a distance L. The first and second webs of panel material 38 and 39 are disposed along a horizontal plane, directed to feeding rollers and fed longitudinally thereof and intermittently, as in the case of the first and second webs of panel material 1 and 2 of FIG. 1. The apparatus includes an aperture forming device by which an aperture is formed in the first web of panel material 38 at a position between the one side edges of the first and second webs of panel material 38 and 39 when the first and second web of panel material 38 and 39 are stopped temporarily whenever being fed intermittently. In addition, a spout 5 is inserted into the aperture by a spout inserting device when the first and second webs of panel material 38 and 39 are stopped temporarily whenever being fed intermittently, the spout 5 and the first web of panel material 38 being heat sealed with each other by a spout seal device when the first and second webs of panel material 38 and 39 are stopped temporarily whenever being fed intermittently (FIG. 4A), as in the case of the spout 5 of FIG. 1.

The apparatus further includes a guide device by which the first web of panel material 38 is guided to be folded and folded back along a longitudinal folded line 40 and a longitudinal folded back line 41 extending at positions predetermined widthwise of the first web of panel material 38 when the first and second webs of panel material 38 and 39 are fed after the spout 5 and the first web of panel material 38 are heat sealed so that a folded portion 42 and a folded back portion 43 should be formed in the first web of panel material 38. In the embodiment, the folded portion 43 includes one side edge coincided with one side edge of the second web of panel material 39. The spout 5 and the longitudinal folded line 40 are positioned between the one side edge of the first web of panel material 38 and the longitudinal folded back line 41 and formed between the one side edge of the second web of panel material 39 and the longitudinal folded back line 41 (FIG. 4 B).

Figure 5:
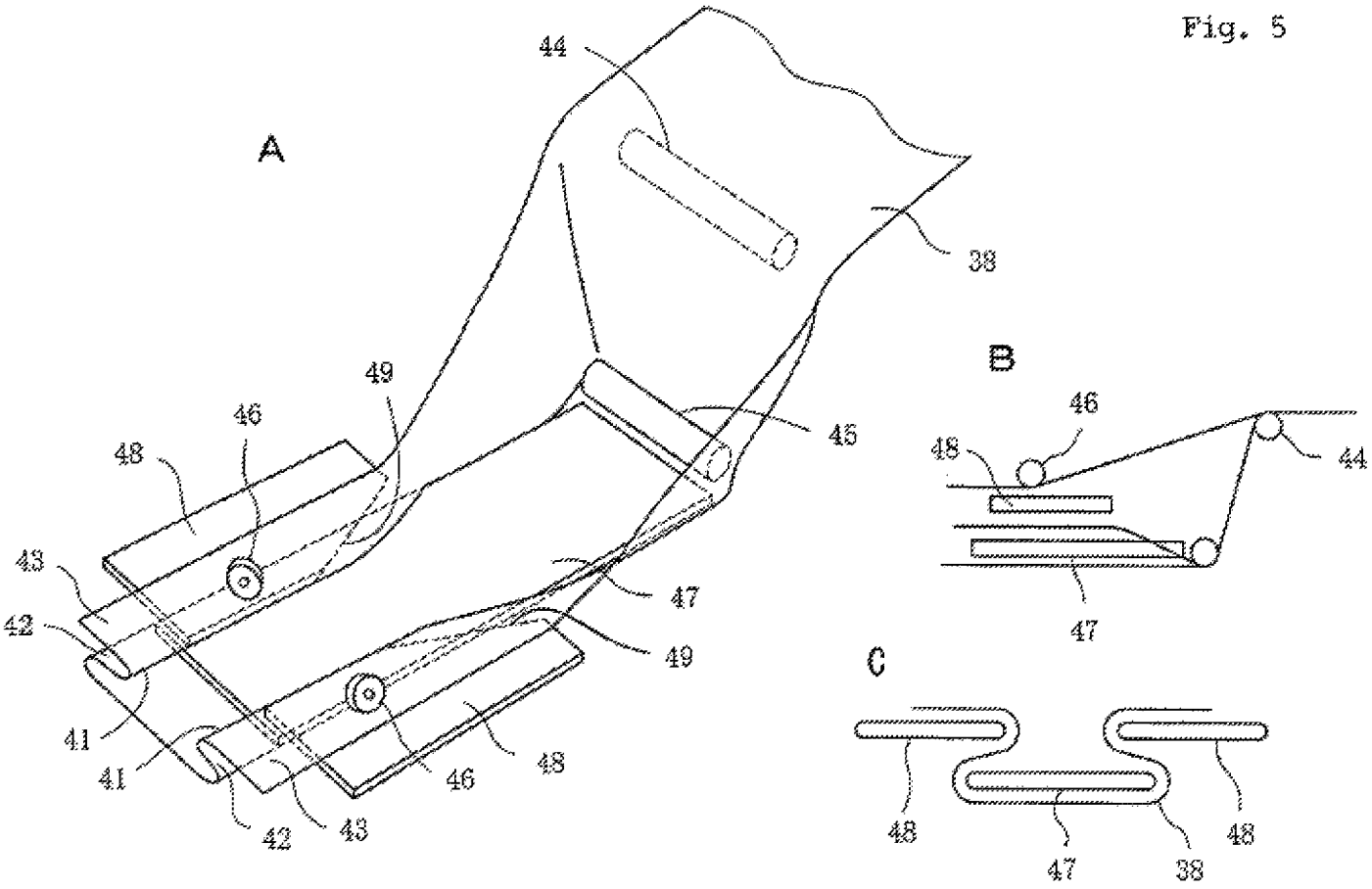
FIG. 5 is a perspective view (A) of the first web of panel material of FIG. 4 when being folded and folded back, a side view (B) of the first web of panel material of (A) and an elevational and sectional view (C) of the first web of panel material of (A).

For example, the guide device comprises guide rollers 44, 45 and 46 and plates 47 and 48, the first web of panel material 38 passing through the guide roller 44 to be directed to the guide roller 45, as shown in FIG. 5. The first web of panel material 38 is then directed to the plate 47 and disposed on the lower side thereof to be pulled down and folded by the guide roller 45 and the plate 47. The plate 48 and the guide roller 46 are disposed above the plate 47, the plate 48 including an inclined edge 49. The first web of panel material 38 is interposed between the plates 47 and 48 and guided and folded back by the inclined edge 49 so that the folded back portion 43 should be interposed between the guide roller 46 and the plate 48. It should therefore be understood that the first web of panel material 38 is folded and folded back along the longitudinal folded line 40 and the longitudinal folded back line 41.

In the embodiment of FIG. 4, the apparatus is arranged to make the plastic bags two by two. The first web of panel material 38 have therefore opposite side edges protruding beyond opposite side edges of the second web of panel material 39 at the distance L. In addition, apertures are formed in the first web of panel material 38 at positions between the opposite side edges of the first and second webs of panel material 38 and 39, the spouts being inserted into the apertures, the spouts and the first web of panel material 38 being heat sealed with each other. The first web of panel material 38 are then folded and folded back along longitudinal folded lines 40 and longitudinal folded back lines 41. The spouts 5 and the longitudinal folded lines 40 are positioned between the opposite side edges of the first web of panel material 38 and the longitudinal folded back lines 41 and between the opposite side edges of the second web of panel material 39 and the longitudinal folded back lines 41.

The apparatus includes a circumferential seal device by which the folded back portion 43 and the folded portion 42 are heat sealed with each other while the folded back portion 43 and the second web of panel material 39 are heat sealed with each other about the spout 5 (FIG. 4 C), as in the case of the apparatus of FIG. 1.

In the embodiment of FIG. 4, the apparatus includes an end surface material supply from which a web of end surface material 4 is supplied and a temporarily fixing device by which the web of end surface material 4 and the second web of panel material 39 are temporarily fixed to each other, as in the case of the apparatus of FIG. 1. The first and second webs of panel material 38 and 39 and the web of end surface material 4 are then heat sealed with each other by a longitudinal seal device, the first and second webs of panel material 38 and 39 being heat sealed with each other by a cross seal device, when the first and second webs of panel material 38 and 39 are stopped temporarily whenever being fed intermittently. In addition, the first and second webs of panel material 38 and 39 and the web of end surface material 4 are slit by a slitting blade, the first and second webs of panel material 38 and 39 being cut by a cross cutter.

The apparatus can therefore successively make plastic bags. In this case, the panel portions are formed by the first and second webs of panel material 38 and 39. The end surface is formed by the folded back portion 43 to be provided with the spout 5.

Figure 6:
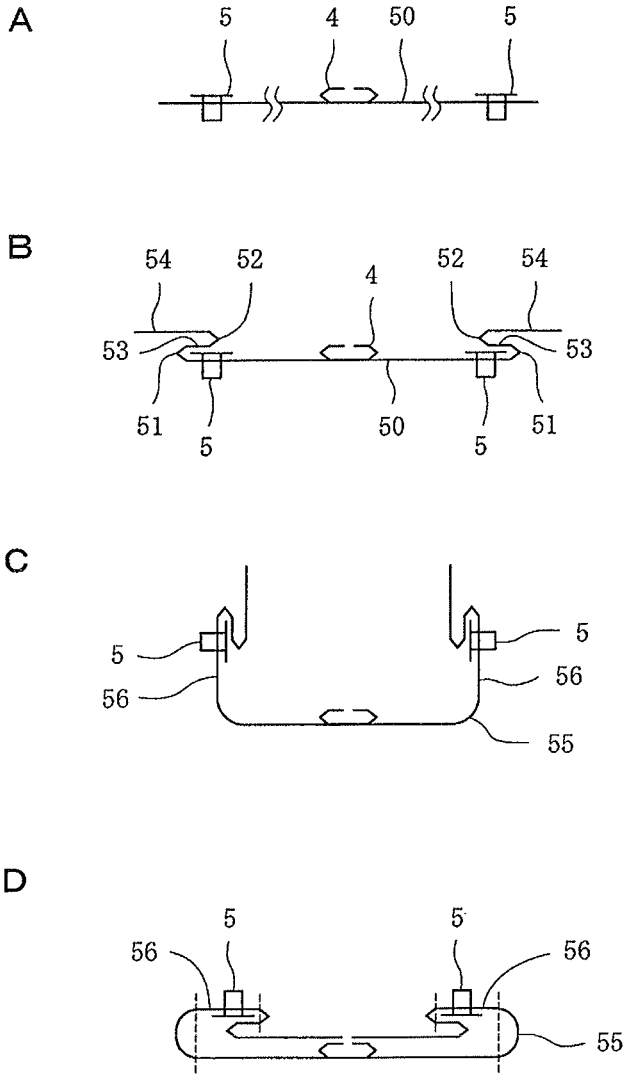
FIG. 6 is an elevational and sectional view (A) of another embodiment, an elevational and sectional view (B) of the step next to (A), an elevational and sectional view (C) of the step next to (B) and an elevational and sectional view (D) of the step next to (C).

In another embodiment of FIG. 6, the apparatus includes a feeding device by which a wide web of panel material 50 is fed longitudinally thereof and intermittently. The apparatus further includes an aperture forming device by which an aperture is formed in the wide web of panel material 50 at a position predetermined widthwise of the wide web of panel material 50 when the wide web of panel material 50 is stopped temporarily whenever being fed intermittently. The apparatus further includes a spout inserting device by which a spout 5 is inserted into the aperture when the wide web of panel material 50 is stopped temporarily whenever being fed intermittently. The apparatus further includes a spout seal device by which the spout 5 and the wide web of panel material 50 are heat sealed with each other when the wide web of panel material 50 is stopped temporarily whenever being fed intermittently (FIG. 6 A).

The apparatus further includes a guide device by which the wide web of panel material 50 is guided to be folded and folded back along a first longitudinal folded line 51 and a longitudinal folded back line 52 extending between one side edge and the spout 5 when the wide web of panel material 50 is fed after the spout 5 and the wide web of panel material 50 are heat sealed so that a first folded portion 53 and a folded back portion 54 should be formed in the wide web of panel material 50. The apparatus is also arranged to successively make the plastic bags two by two. The wide web of panel material 50 are therefore folded and folded back along first longitudinal folded lines 51 and longitudinal folded back lines 52 extending between opposite side edges and the spouts 5 (FIG. 6 B).

The wide web of panel material 50 is then folded along a second longitudinal folded line 55 extending at position predetermined widthwise of the wide web of panel material 50 so that a second folded portion 56 should be formed in the wide web of panel material 50 (FIG. 6 C). The wide web of panel material 50 is folded completely, the spout 5 being turned over by the second folded portion 56, the spout 5 and the folded back line 52 being positioned between the first and second longitudinal folded lines 51 and 55. In addition, the apparatus includes a circumferential seal device by which the second folded portion 56 and the first folded portion 53 are heat sealed with each other while the second folded portion 56 and the wide web of panel material 50 are heat sealed with each other about the spout 5 when the wide web of panel material 50 is stopped temporarily whenever being fed intermittently (FIG. 6 D).

The apparatus further includes an end surface material supply from which a web of end surface material 4 is supplied. The wide web of panel material 50, the folded back portion 54 and the web of end surface material 4 are then heat sealed with each other by a longitudinal heat seal device. The wide web of panel material 50 and the folded back portion 54 are heat sealed with each other by a cross seal device. In addition, the wide web of panel material 50 and the web of end surface material 4 are slit by a slitting blade, the wide web of panel material 50 being cut by a cross cutter.

The apparatus therefore can successively make the plastic bags. In this case, the panel portions are formed by the wide web of panel material 50 and the folded back portion 54. The end surface is formed by the second folded portion 56 to be provided with the spout 5.

Figure 7:
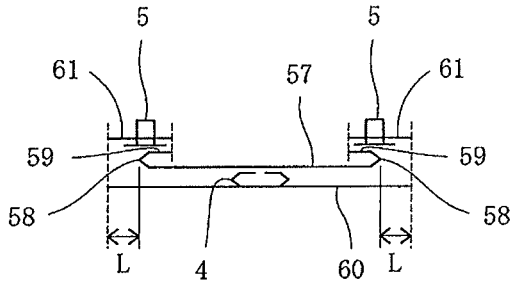
FIG. 7 is an elevational and sectional view of another embodiment.

In another embodiment of FIG. 7, a first web of panel material 57 is previously folded along a longitudinal folded line 58 extending adjacent to one side edge so that a folded portion 59 should be formed in the first web of panel material 57. A second web of panel material 60 is then superposed with the first web of panel material 57 on opposite side to the folded portion 59 to have one side edge protruding beyond the longitudinal folded line 58 at a distance L. The apparatus is arranged to make the plastic bags two by two. The first web of panel material 57 is therefore folded along longitudinal folded lines 58 extending adjacent to opposite side edges. The second web of panel material 60 is superposed with the first web of panel material 57 to have opposite side edges protruding beyond the longitudinal folded lines 58 at the distance L.

In addition, the first and second webs of panel material 57 and 60 are disposed along a horizontal plane and fed longitudinally thereof and intermittently, with which a web of end surface material 61 is combined. The web of end surface material 61 includes apertures formed therein and spaced from each other longitudinally of the web of end surface material 61. The web of end surface material 61 further includes spouts 5 inserted into the apertures, the spouts and the web of end surface material 61 being heat sealed with each other. The web of end surface material 61 is then supplied to the first and second webs of panel material 57 and 60 to extend along the longitudinal folded line 58 so that the web of end surface material 61 should be superposed with the folded portion 59 and the second web of panel material 60. For example, the first and second webs of panel material 57 and 60 and the web of end surface material 61 are directed to feeding rollers after the web of end surface material 61 is supplied. The web of end surface material 61 is therefore fed intermittently by the feeding rollers. In addition, the aperture is formed in the web of end surface material 61 by an aperture forming device before the web of end surface material 61 is supplied and when the web of end surface material 61 is stopped temporarily whenever being fed intermittently. The spout 5 is then inserted into the aperture by a spout inserting device when the web of end surface material 61 is stopped temporarily whenever being fed intermittently. The spout 5 and the web of end surface material 61 are heat sealed with each other by a spout seal device whenever the web of end surface material 61 is stopped temporarily whenever being fed intermittently. The web of end surface material 61 is then supplied to the first and second webs of panel material 57 and 60, the first and second webs of panel material 57 and 60 and the web of end surface material 61 being directed to and fed intermittently by feeding rollers. The web of end surface material 61 and the folded portion 59 are heat sealed with each other while the web of end surface material 61 and the second web of panel material 60 are heat sealed with each other about the spout 5 by a circumferential seal device whenever the first and second webs of panel material 57 and 60 are stopped temporarily whenever being fed intermittently.

In addition, the web of end surface material 4 is supplied from an end surface material supply. The first and second webs of panel material 57 and 60 and the web of end surface material 4 are heat sealed with each other by a longitudinal seal device, the first and second webs of panel material 57 and 60 being heat sealed with each other by a cross seal device. The first and second webs of panel material 57 and 60 and the web of end surface material 4 are then slit by a slitting blade, the first and second webs of panel material 57 and 60 being cut by a cross cutter.

The apparatus can therefore successively make the plastic bags. In this case, the panel portions are formed by the first and second webs of panel material 57 and 60. The end surface is formed by the web of end surface material 61 to be provided with the spout 5.

In each of the embodiments, it should be understood that processes are performed by elements such as the aperture forming device, the spout seal device and the like when the webs of panel material 1, 2, 38, 39, 50, 57 and 60 are stopped temporarily whenever being fed intermittently. In this connection, it should also be understood that all the elements have not always to be synchronous with each other. Some of the processes may be performed by some of the elements whenever the webs of panel material are fed intermittently. All the processes or some of them may be performed by all the elements or some of them whenever the webs of panel material are fed intermittently several times.

We claim:

1. An apparatus for successively making plastic bags each of which includes an end surface provided with a spout, the apparatus comprising:

a feeding device by which a first web of panel material and a second web of panel material are disposed along a horizontal plane and fed longitudinally thereof and intermittently, the first web of panel material being previously folded along a longitudinal folded line extending adjacent to one side edge of the first web of panel material so that a folded portion is formed in the first web of panel material, the second web of panel material being different from the first web of panel material and superposed with the first web of panel material on a side of the first web of panel material opposite to the folded portion to have one side edge of the second web of panel material protruding beyond the longitudinal folded line;

an end surface material supply mechanism by which a web of end surface material is supplied to the first web of panel material and the second web of panel material to extend along the longitudinal folded line such that the web of end surface material is superposed with the folded portion and the second web of panel material, the web of end surface material comprising apertures formed therein and spaced from each other longitudinally along the web of end surface material defining a longitudinal line along the web of end surface material, the web of end surface material further comprising spouts inserted into the apertures, the spouts and the web of end surface material being heat sealed with each other; and a circumferential seal device by which the web of end surface material and the folded portion are heat sealed with each other while the web of end surface material and the second web of panel material are heat sealed with each other about the spout when the first web of panel material, the second web of panel material, and the web of end surface material are stopped temporarily, the end surface provided with a spout being formed by the web of end surface material.

2. The apparatus of claim 1, wherein the circumferential seal device comprises:

a first heat seal device for heat-sealing the web of end surface material and the folded portion on one side of the longitudinal line extending through the spouts of the web of end surface material, and a second heat seal device for heat-sealing the web of end surface material and the second web of panel material on a side of the longitudinal line extending through the spouts of the web of end surface material opposite to the first heat seal device, wherein the first heat seal device comprises a heat seal bar, a plate and a receiver, wherein the first heat seal device is configured to heat-seal by sandwiching the web of end surface material, the first web of panel material, and the second web of panel material between the heat seal bar and the receiver such that the plate is inserted between the folded portion and the first web of panel material, and wherein the first heat seal device and the second heat seal device are configured to form heat seal portions surrounding the spout of the web of end surface material.

3. The apparatus of claim 1, wherein both sides of the first web of panel material are provided with the folded portion respectively in the width direction, wherein the end surface material supply mechanism is configured to supply webs of end surface material with the heat-sealed spouts in two rows so as to supply the webs of end surface material on both of the folded portions, and to stack the webs of the end surface material on the second web of panel material.

4. The apparatus of claim 3, wherein another web of end surface material is supplied to a position between the first web of panel material and the second web of panel material along a longitudinal center line of the first web of panel material and the second web of panel material, wherein the other web of end surface material is heat-sealed with the first web of panel material and the second web of panel material, and the other web of end surface material forms the end surface opposing to the end surface with the heat-sealed spout in two rows of plastic bags formed by dividing along the longitudinal center line.

* * * * *